US008635782B2

(12) United States Patent
Russell, III

(10) Patent No.: US 8,635,782 B2
(45) Date of Patent: Jan. 28, 2014

(54) KNIFE

(76) Inventor: Andrew G. Russell, III, Springdale, AR (US)

( * ) Notice: Subject to any disclaimer, the term of this patent is extended or adjusted under 35 U.S.C. 154(b) by 769 days.

(21) Appl. No.: 12/655,620

(22) Filed: Jan. 4, 2010

(65) Prior Publication Data

US 2010/0170095 A1 Jul. 8, 2010

Related U.S. Application Data

(60) Provisional application No. 61/204,142, filed on Jan. 5, 2009.

(51) Int. Cl.
*B25G 1/00* (2006.01)

(52) U.S. Cl.
USPC ..... 30/340; 30/342; 30/344

(58) Field of Classification Search
USPC ..... 30/342, 344, 339, 337, 340, 329; 16/406, 422
See application file for complete search history.

(56) References Cited

U.S. PATENT DOCUMENTS

| | | | | | |
|---|---|---|---|---|---|
| 97,991 | A * | 12/1869 | Taylor | 30/342 |
| 485,236 | A * | 11/1892 | Steinle | 279/24 |
| 1,563,674 | A * | 12/1925 | Stuart | 30/339 |
| 1,997,131 | A * | 4/1935 | Champlin | 30/342 |
| 2,335,872 | A * | 12/1943 | Mitchell | 30/342 |
| 2,695,450 | A * | 11/1954 | Platts | 30/342 |
| 2,787,059 | A * | 4/1957 | Wingen | 30/342 |
| 3,114,973 | A * | 12/1963 | Kennedy | 30/342 |
| 4,272,332 | A * | 6/1981 | Probost | 205/122 |
| 4,355,465 | A * | 10/1982 | Besson | 30/344 |
| 5,155,913 | A * | 10/1992 | Marttiini | 30/342 |
| 6,070,329 | A * | 6/2000 | Gibbs | 30/344 |
| 6,625,890 | B2 * | 9/2003 | Hufnagel et al. | 30/344 |
| 6,782,626 | B1 * | 8/2004 | Gibbs | 30/342 |
| 7,500,314 | B2 * | 3/2009 | Luber | 30/339 |
| 8,065,942 | B2 * | 11/2011 | Loehnert et al. | 83/13 |
| 2001/0020332 | A1 * | 9/2001 | Stein et al. | 30/342 |
| 2011/0061249 | A1 * | 3/2011 | Ma et al. | 30/520 |

* cited by examiner

*Primary Examiner* — Omar Flores Sanchez
(74) *Attorney, Agent, or Firm* — Boyd D. Cox

(57) ABSTRACT

A knife having an interlocking arrangement between handle assembly and the blade assembly provides a durable connection between the knife's blade and handle. Additionally, by directly connecting the blade assembly to the hilt section of the knife, the connection between the blade assembly and handle assembly is not only strong, but also, the size of the blade is not limited by the size of the hilt section on the handle assembly.

16 Claims, 3 Drawing Sheets

KNIFE

Priority for this application is claimed from U.S. Provisional Application No. 61/204,142 entitled "Knife" filed on Jan. 5, 2009

BACKGROUND

The present invention is directed to a knife, particularly the construction of the handle on the knife, in which a blade of the knife has tang which comprises an extension fitted within the handle assembly.

One of the weakest parts of a knife is the connection between the handle and the blade of the knife. Failure of a knife typically occurs when the handle loosens from the blade. When loosened, the handle can easily separate from knife blade. With the handle loosened or separated from the blade, a knife becomes impossible to use effectively and safely.

On most knives, the handle includes a cover which provides a grip for a user to comfortably hold the knife during use. It is not uncommon after some use for the handle's cover of the prior art to become dislodged from the knife's handle, making the knife difficult to hold and inconvenient to use. Thus, the knife must be repaired or discarded even though the blade might be in good condition, thereby foreshortening the useable life of the knife.

There is a need for a knife having a handle that is firmly and securely attached to the blade with reduced potential for separation between the handle and blade. Such a knife, having a strong, durable connection between the handle and blade, ensures that the knife can withstand prolonged use. There is also a need for a handle assembly having a cover that can withstand prolonged use without detaching from the handle.

Furthermore, it is necessary to provide a knife that is easy to assemble in order to minimize manufacturing cost.

In the present invention, an interlocking arrangement between the chassis and the tang, combined with the plurality of connecting means provides a durable connection between the handle and the blade of the knife and also between the handle and cover of the knife. With a reduced possibility of the handle loosening and/or detaching from the blade and the cover detaching from the handle, the useable life of the knife can be extended.

SUMMARY

The knife of the present invention comprises a blade assembly and a handle assembly. The blade assembly includes a blade and an extension, or tang. The blade is characterized by a cutting edge. The handle assembly includes a chassis and a handle cover both of which are adjoined to the tang of the blade assembly. The knife also includes means for directly connecting the tang to the hilt section of the handle assembly, means for connecting the handle cover to the tang and means for connecting the handle cover to the chassis of the handle assembly.

It is an object of the present invention to provide a knife having a handle that securely attaches to the blade.

It is a further object of the present invention to provide a knife handle that allows for greater variation in the size of the blade to be used with that handle.

It is a further object of the present invention to provide a knife handle that allows the size of the knife's blade to be larger than the size of the handle's hilt.

It is a further object of the present invention to provide a knife with an extended lifetime of use.

It is a further object of the present invention to provide a knife having an interlocking connection between the handle assembly and the blade assembly.

BRIEF DESCRIPTION OF THE DRAWINGS

Reference is made to the accompanying drawings in which are shown illustrative embodiments of the invention and from which novel features and advantages will be apparent.

DETAILED DESCRIPTION

Figure 1:
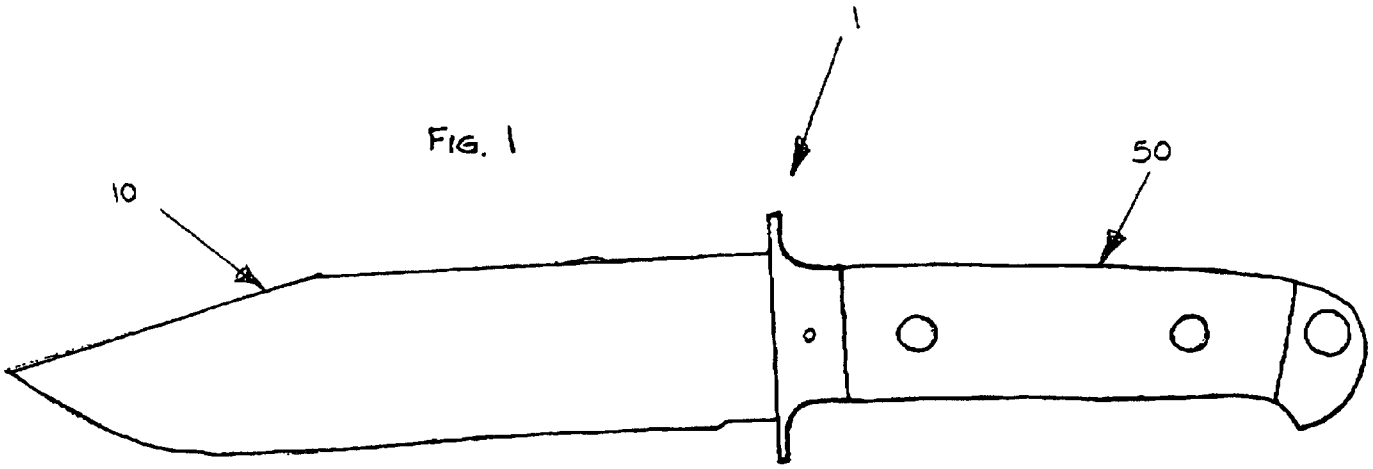
FIG. 1. is a side view of the knife of the present invention.

The knife 1 shown in FIG. 1 includes a blade assembly 10 and a handle assembly 50.

Figure 2:
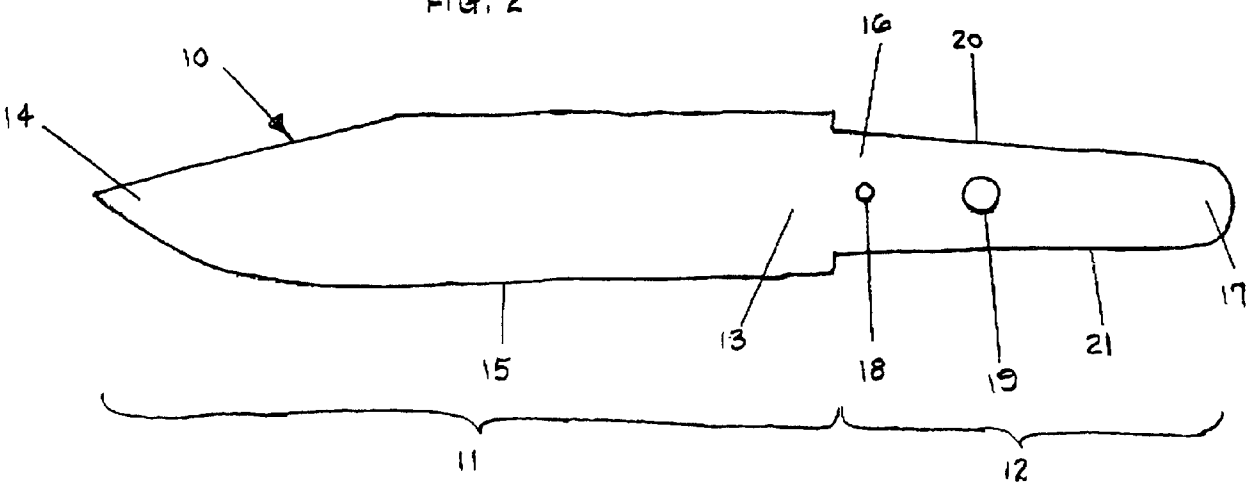
FIG. 2 is a side view of the blade assembly of the present invention shown in FIG. 1.

Referring to FIG. 2, the blade assembly 10 includes an elongated blade 11 and a tang 12 in FIG. 2. The elongated blade 11 has a cutting edge 15. The tang 12 has first 20 and second 21 tapered edges.

Figure 3:
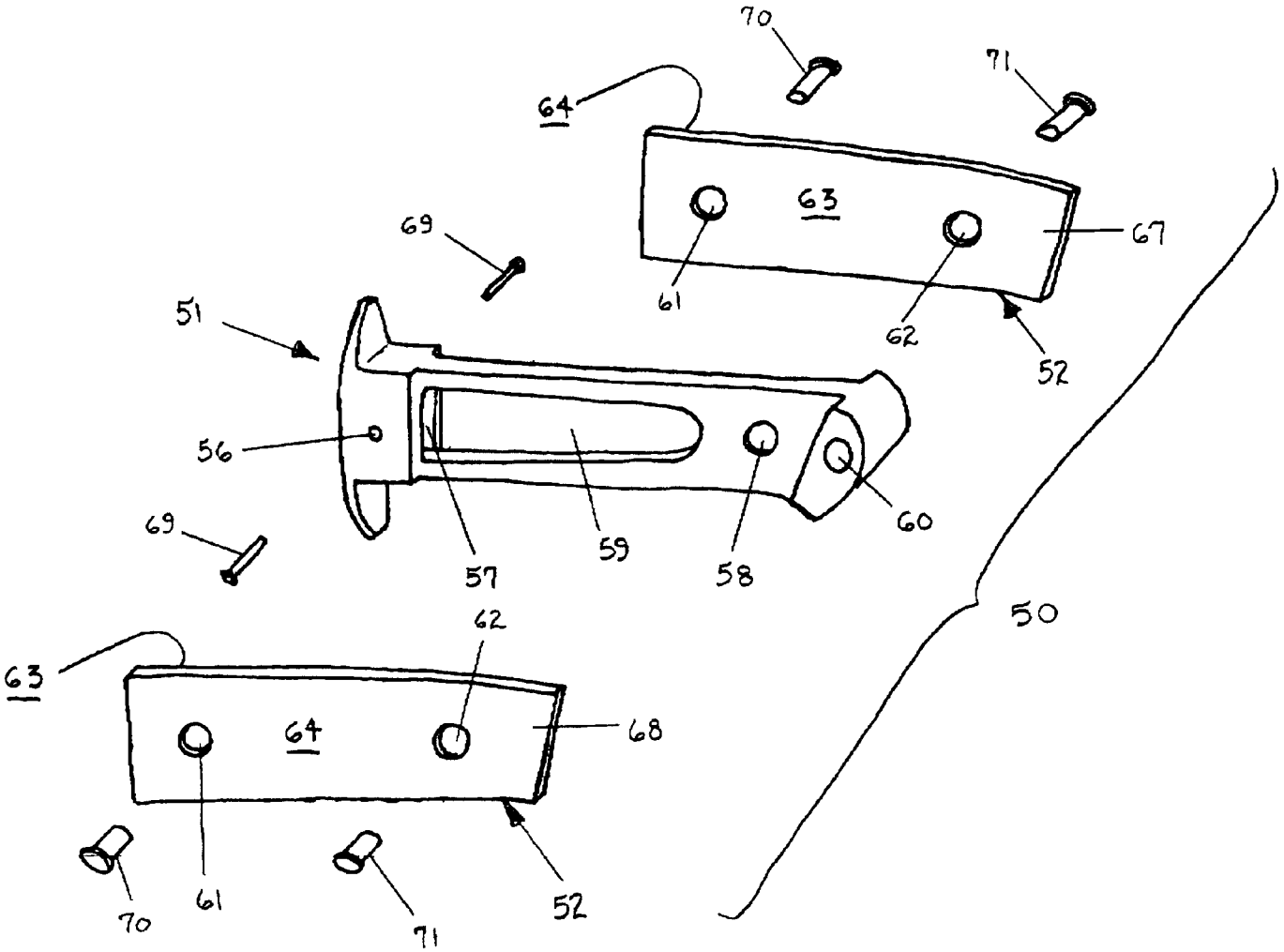
FIG. 3 is an exploded side view of the handle of the present invention shown in FIG. 1.
Figure 4:
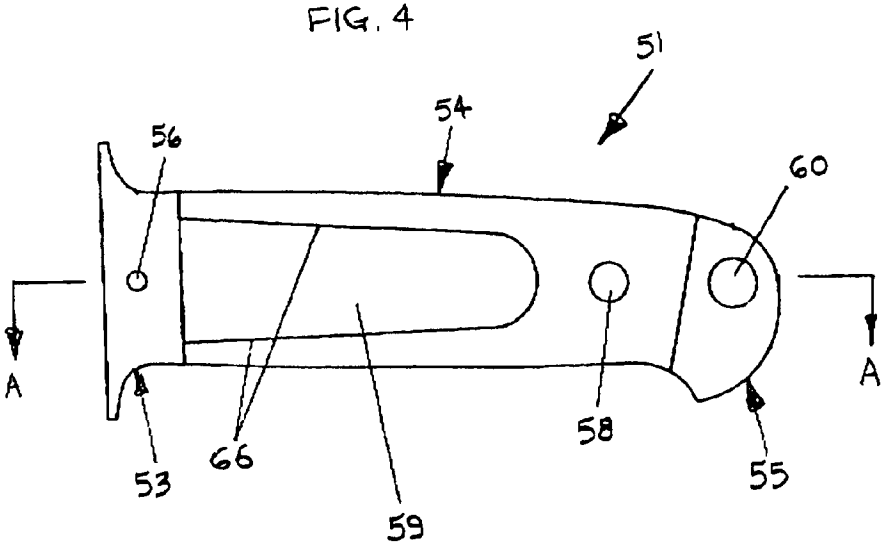
FIG. 4 is a side view of the chassis of the present invention as shown in FIG. 1.
Figure 5:
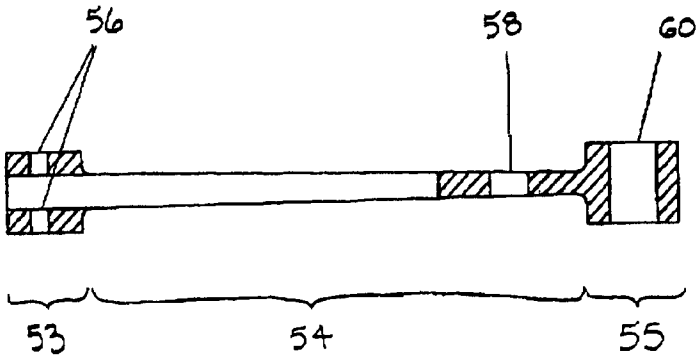
FIG. 5 is a cross-sectional view of the chassis of the present invention taken along line A-A in FIG. 4.
Figure 6:
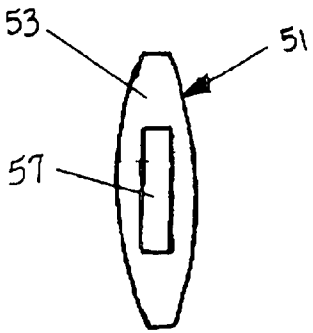
FIG. 6 is a front view of the chassis of the present invention shown in FIG. 4.

The handle assembly 50 as shown in FIG. 3 is comprised by a chassis 51 and a handle cover 52. Referring to FIGS. 4-6, the chassis 51 has three sections which include a hilt section 53, a body section 54 and an end section 55. The hilt section 53 has an opening 57 extending therethrough. The body section 54 includes a means for receiving the tang which comprises a cavity 59. The cavity 59 has a pair of tapered walls 66 disposed oppositely from each other. The end section 55 has an end aperture 60 therethrough.

The handle cover 52 as shown in FIG. 3 is a sheath which includes a pair of plates. The pair of plates includes first 67 and second 68 plates. Each of the first 67 and second 68 plates has inner 63 and outer 64 surfaces.

The knife 1 also includes means for connecting the tang to the hilt section of the chassis, means for connecting the handle cover to the tang and means for connecting the handle cover to the body section of the chassis.

The means for connecting the tang to the hilt section of the chassis comprises a first tang aperture 18 disposed on the tang 12 of the blade assembly 10, a first chassis aperture 56 disposed in the hilt section of the chassis 51 and a first fastener 69 as shown in FIGS. 2 and 3. The first fastener 69 is a pin that extends through the first chassis aperture 56 and the first tang aperture 18 to thereby secure the tang 12 directly to the hilt section 53.

The means for connecting the handle cover to the tang comprises a second tang aperture 19 disposed on the tang 12 and a pair of first handle cover apertures 61. Each of the first handle cover apertures 61 is disposed on a respective one of the first 67 and second 68 plates of the handle cover 52. The means for connecting the handle cover to the tang further comprises a second fastener 70 that extends through the second tang aperture 19, each of the first handle cover apertures 61 and the cavity 59 of the body section 54 to secure the first 67 and second 68 plates of the handle cover 52 directly to the tang 12.

The means for connecting the handle cover to the body section comprises a second chassis aperture 58 disposed in the body section 54 and a pair of second handle cover apertures 62. Each of the second handle cover apertures 62 is disposed on a respective one of the first 67 and second 68 plates of the handle cover 52. The means for connecting the handle cover to the body section further comprises a third fastener 71 that extends through the second chassis aperture 58 and each of the second handle cover apertures 62 to secure the first 67 and second 68 parts of the handle cover 52 directly to the body section 54.

The blade 11 is elongated and generally planar in shape with distal 14 and proximal 13 ends. Similarly, the tang 12 is elongated with a generally planar profile. The tang 12 has proximal 16 and distal 17 ends. The first 20 and second 21 tapered edges of the tang 12 are angled towards each other along the length of the tang 12 from the proximal end 16 to the distal end 17.

In a preferred embodiment, the cavity 59 of the body section 54 has tapered walls 66 that generally conform in shape with the tapered edges 20, 21 of the tang 12.

Preferably, the chassis 51 is cast metal in a single integral piece. Although steel is preferred for casting the chassis 51, other suitable materials could be used instead. The tang 12 and the blade 11 are integrally formed in a preferred embodiment.

When the knife 1 is assembled, the tang 12 extends through the opening 57 of the hilt section 53 and into the cavity 59 of the body section 54. The hilt section 53 encircles the tang 12. An interlocking connection is created between the tang 12 and the chassis 51. This interlocking connection helps to securely attach the blade assembly 10 to the handle assembly 50 which deters relative movement between the two.

The means for connecting the tang to the hilt section attaches the tang 12 directly to the hilt section 53. The first fastener 69 extends through the first chassis aperture 56 in the hilt section 53 and the first tang aperture 18 in the tang 12. The means for connecting the handle cover to the tang secures the first 67 and second 68 parts of the handle cover 52 directly to the tang 12. The means for connecting the handle cover to the body section includes the third fastener 71 which engages each of the second cover apertures 62 and the second chassis aperture 58 to connect the first 67 and second 68 plates of the handle cover 52 directly to the body section 54.

On the blade assembly 10, the proximal end 13 of the blade 11 is attached to the proximal end 16 of the tang 12. Preferably, the tang 12 and blade 11 are integrally formed as a single unit. A portion of the tang 12 extends through the opening 57 of the hilt section 53. A substantial portion of the tang 12 is held within the cavity 59 of the body section 54 and the tapered walls 66 of the body section 54 generally conform to the first 20 and second 21 tapered edges of the tang 12.

The first 67 and second 68 plates of the handle cover are disposed adjacent to the chassis 51. Specifically, the inner surface 63 of the first plate 67 is positioned against one side of the chassis's body section 54. The second plate 68 of the handle cover 52 is disposed adjacent a side of the body section 54 that is opposite to the first part 67. Consequently, the plates 67, 68 of the handle cover 52 at least partially surround the chassis 51.

Regarding the means for connecting the tang to the hilt section, the first chassis aperture 56 is aligned with the first tang aperture 18 and the first fastener 69 extends through the two apertures.

In the means for connecting the handle cover to the tang, the second tang aperture 19 is aligned with the first cover aperture 61 and both apertures are horizontally aligned over a portion of the cavity 59 in the body section 54. The second fastener 70 extends through the first cover aperture 61 and the second tang aperture 19 and the cavity 59.

Regarding the means for connecting the handle cover to the body section, the second cover aperture 62 is aligned with the second chassis aperture 58. The third fastener 71 extends through the second cover apertures 62 on the first 67 and second 68 plates and the second chassis aperture 58.

The tang 12 extends through the opening 57 in the hilt section 53 and is held within the cavity 59 of the body section 54. Consequently, the opening 57 and cavity 59 generally conform in size and shape with portions of the tang 12. It is preferable that the tang 12 fit snugly within the opening 57 of the chassis 51 in order to provide a secure attachment between the handle assembly 50 and the blade assembly 10.

On the knife 1, the first fastener 69 is disposed along a length of the chassis 51 at a location that is spaced a distance from the blade 11. The third fastener 71 is disposed along a length of the chassis 51 at a location that is spaced a farther distance from the blade than the first fastener 69. The second fastener 70 is disposed along a length of the chassis 51 at a location between the first 69 and third 71 fastener. Consequently, the first fastener 69 is closer to the blade 11 than the second fastener 70 and the second fastener 70 is located closer to the blade 11 than the third fastener 71.

The handle cover 52 of the handle assembly 50 is attached to the chassis 51 at two points via the second 70 and third 71 fasteners. This attachment securely holds the handle cover 52 to the chassis 51 and further secures the tang 12 of the blade assembly 10 to the handle assembly 52. The tang 12 is also attached to the hilt section 53 by the first fastener 69, thereby providing a second point at which the tang 12 is connected to the chassis 51. This attachment further secures the blade assembly 10 to the handle assembly 52.

Consequently, the means for connecting the tang to the hilt section, the means for connecting the handle cover to the tang, the means for connecting the handle cover to the body section, and the cooperating shapes of the tang 12 and cavity 59 provide a secure attachment between the handle 50 and the blade 10 assemblies of the knife 1.

The present invention provides an interlocking connection between the handle assembly and blade assembly of a knife that renders the knife easy to assemble while providing a durable and strong connection between the handle and the blade. The durable, strong connection between the handle and the blade extend the useable life of the knife.

Furthermore, the size of the knife's blade is not limited by the size of the hilt. With the tang being received within the chassis for attachment, the blade can be sized independently of the handle and hilt without affecting that attachment between the tang and the handle's chassis. In addition, the attachment is stronger and more durable, thereby deterring separation of the handle from the knife during use.

Although the present invention has been described in considerable detail with reference to certain preferred versions thereof, other versions are possible. Therefore, the spirit and scope of the appended claims should not be limited to the description of the preferred versions that are contained herein.

The invention claimed is:

1. A knife comprising:

a blade assembly; and a handle assembly;

said blade assembly comprising a blade and a tang extending outwardly from said blade, wherein said blade having a cutting edge;

said handle assembly comprising a chassis and a handle cover;

said chassis having a unitary hilt section, a body section and an end section;

wherein said body section being elongated having two ends with said unitary hilt section being disposed on one end of said body section and said end section being disposed on the other end of said body section opposite said unitary hilt section;

said unitary hilt section including an opening;

wherein said tang extending through said opening into the body section of the chassis, said unitary hilt section being adjacent to said blade, and said handle cover at least partially surrounding the body section of the chassis; and means for connecting the tang directly to the unitary hilt section;

means for connecting the handle cover to the tang disposed along the length of said body section; and means for connecting the handle cover to the chassis disposed along the length of said body section.

2. The knife of claim 1, wherein said means for connecting the tang to the unitary hilt section comprises a first fastener, a first chassis aperture extending through the unitary hilt section and a first tang aperture extending through said tang;

wherein said first fastener extends through said first chassis aperture, through said first tang aperture and through said opening to connect said unitary hilt section directly to said tang.

3. The knife of claim 2, wherein said means for connecting the handle cover to the tang comprises a second fastener, a second tang aperture extending through the tang, and at least one first cover aperture;

said chassis further includes a body cavity disposed in said body section;

said tang is partially disposed within said body cavity of the chassis;

wherein said second fastener extends through said second tang aperture and said first cover aperture to secure the handle cover directly to the chassis and tang.

4. The knife of claim 3, wherein said means for connecting the handle cover to the chassis comprises a third fastener, a second cover aperture and a second chassis aperture;

wherein said third fastener extends through said second cover aperture and said second chassis aperture to secure the cover directly to said chassis.

5. The knife of claim 2, wherein said tang having proximal and distal ends and first and second opposing edges, wherein said first and second edges diverge along a length of the tang extending from the distal end to the proximal end; and said body cavity in the body section having tapered walls that generally conform to the opposing edges of the tang.

6. The knife of claim 3, wherein said handle cover comprises a pair of plates;

wherein each of said plates overlays and is adjacent to a portion of said body section; each of said plates overlays and is adjacent to a portion of said tang; and each of said plates comprises one of said at least one first cover aperture which receives the second fastener therein.

7. The knife of claim 1, wherein said unitary hilt section having a width greater than a width of the body section.

8. The knife of claim 1, wherein said tang is adjacent to said handle cover.

9. A knife comprising:

a blade assembly;

a handle assembly; and a plurality of fasteners;

said blade assembly including an elongated blade and a tang extending outwardly from said elongated blade;

said elongated blade having a cutting edge; and said tang further comprising proximal and distal ends, first and second tang apertures, first and second opposing edges and a length, wherein said proximal end is attached to said blade, and said first and second opposing edges diverge along the length of the tang extending from the distal to the proximal end;

said handle assembly including a chassis and a handle cover;

said chassis having a unitary hilt section, a body section and an end section, wherein said handle at least partially surrounds said body section of the chassis;

said unitary hilt section having a first chassis aperture, an opening, and a width that is greater than a width of the body section;

said body section having a second chassis aperture and a body cavity;

said body cavity having tapered walls which generally conform to the shape of the tapered edges of the tang;

said handle cover comprising first and second plates, wherein each of said first and second plates having first and second cover apertures and inner and outer surfaces;

said plurality of fasteners comprises first, second and third fasteners;

wherein said tang extends through the opening in the unitary hilt section and into the body cavity of the body section, whereby the proximal end of the tang is held within the opening of the unitary hilt section, the opposing edges of the tang are adjacent to the tapered walls of the body cavity, and the inner surface of each plate is adjacent to the body section of the chassis and a portion of the tang;

wherein said first fastener extends through said first chassis aperture and said first tang aperture to connect the unitary hilt section directly to the tang; said second fastener extends through said second tang aperture, said first cover aperture in each of said plates and said body cavity to connect the handle cover directly to the tang;

and said third fastener extends through said second cover aperture and said second chassis aperture to connect said handle cover directly to the chassis.

10. The knife of claim 9, wherein said first fastener is disposed along a length of the chassis a distance that is closer to the blade than a distance between the second fastener and the blade, and a distance between the third fastener and the blade; and wherein the second fastener is disposed along a length of the chassis a distance that is closer to the blade than the distance between the third fastener and the blade.

11. The knife of claim 9, wherein said end section includes an end aperture therethrough.

12. A knife comprising:

a blade assembly;

a handle assembly; and first, second, and third fasteners;

said blade assembly includes a blade and a tang, wherein said blade has a cutting edge;

said tang includes first and second tang apertures;

said handle assembly includes a chassis and a handle cover;

said chassis comprises a unitary hilt section, a body section and an end section, wherein said body section is elongated and has two ends; said unitary hilt section is disposed on one end of the body section and is adjacent to said blade; and said end section is disposed on the other end of said body section opposite to said unitary hilt section;

wherein said handle cover substantially surrounds said body section;

said unitary hilt section comprises a first chassis aperture and an opening, wherein a portion of said tang is disposed in said opening;

said handle cover includes at least one first and at least one second cover apertures;

said body section includes a second chassis aperture;

wherein said first fastener extends through said first chassis aperture and said first tang aperture to secure said tang directly to said unitary hilt section of said chassis; said second fastener extends through said second tang aperture, said at least one first cover aperture and said body cavity of the chassis, to directly secure said handle cover to said tang; and said third fastener extends through said at least one second cover aperture and said second chassis aperture to secure said handle cover directly to said chassis.

13. The knife of claim 12, wherein said body section of the chassis including a body cavity for receiving the tang therein.

14. The knife of claim 13, wherein said handle cover comprising a pair of plates, wherein each of said plates including one of said at least one first cover aperture and one of said at least one second cover aperture.

15. The knife of claim 13, wherein said hilt section having a width greater than a width of the body section.

16. The knife of claim 12, wherein said tang having proximal and distal ends and first and second opposing edges, wherein said proximal end is attached to said blade;

said first and second opposing edges of said tang diverge along a length of the tang extending from the distal end to the proximal end; and said body cavity in the body section having tapered walls that generally conform to the opposing edges of the tang;

wherein said tang is disposed within said body cavity with said opposing edges generally adjacent to the tapered walls of said body cavity.

* * * * *